US005350280A

United States Patent [19]

Yajima et al.

[11] Patent Number: 5,350,280

[45] Date of Patent: Sep. 27, 1994

[54] FLUID COMPRESSOR

[75] Inventors: Toshiya Yajima; Takuya Hirayama; Hirotsugu Sakata; Makoto Hayano; Masayuki Okuda; Naoya Morozumi; Takeshi Kumazawa; Teruo Kobuna, all of Kanagawa, Japan

[73] Assignee: Kabushiki Kaisha Toshiba, Kawasaki, Japan

[21] Appl. No.: 897,690

[22] Filed: Jun. 12, 1992

[30] Foreign Application Priority Data

Jun. 12, 1991 [JP] Japan ..... 3-140089
Oct. 16, 1991 [JP] Japan ..... 3-267609

[51] Int. Cl.[5] ..... F04B 49/00

[52] U.S. Cl. ..... 417/310; 417/356; 418/220

[58] Field of Search ..... 417/356, 310; 418/220

[56] References Cited

U.S. PATENT DOCUMENTS 2,401,189 5/1946 Quiroz ..... 103/117
4,818,195 4/1989 Murayama et al. ..... 418/55.1
4,871,304 10/1989 Iida et al. ..... 418/220
5,026,264 6/1991 Moruzumi et al. ..... 418/220

FOREIGN PATENT DOCUMENTS 57-137677 8/1982 Japan .

*Primary Examiner*—Bertsch' Richard A.
*Assistant Examiner*—M. Kocharov
*Attorney, Agent, or Firm*—Foley & Lardner

[57] ABSTRACT

A fluid compressor comprises a rotary member, a cylinder, and a closed casing for receiving the rotary member and cylinder. The rotary member and cylinder are relatively turned so that a fluid is drawn into work chambers through a suction port, successively compressed and conveyed toward a discharge port through the work chambers, and discharged outside. The fluid compressor is provided with a control valve means. When pressure in the work chambers exceeds a predetermined value during the compressing process, the control valve releases the pressure through a discharge or suction end of the cylinder, or to the inside of the casing.

7 Claims, 11 Drawing Sheets

FLUID COMPRESSOR

BACKGROUND OF THE INVENTION

1. Field of the Invention

This invention relates to a helical blade type fluid compressor for compressing a fluid such as a coolant gas in a refrigerating cycle.

2. Description of the Prior Art

Compressors are usually classified into a reciprocation type and a rotary type. In addition to these two types, there are helical blade type compressors, which successively move a coolant from the suction side of a cylinder toward the discharge side thereof through work chambers to compress the coolant, and discharges the compressed coolant outside.

FIG. 1 shows an example of a conventional helical blade compressor.

In the Figure, the compressor comprises drive means including a stator 101 and a rotor 103, a cylinder 105 rotated by the drive means, and a rotary rod 109 rotated by the cylinder 105 through an oldham ring 107. The rotary rod 109 is eccentric to the cylinder 105 by a distance of "e," and therefore, turnable relative to the cylinder 105 through the oldham ring 107.

A helical groove 111 is formed around the rotary rod 109 substantially over the whole length of the rotary rod 109. A helical blade 113 is movably fitted into the groove 111. The periphery of the blade 113 is In contact with the inner face of the cylinder 105. The blade 113 turns together with the rotary rod 109.

The rotary rod 109 rotates at the eccentric position relative to the cylinder 105, to produce a relative velocity between the periphery of the rotary rod 109 and the inner face of the cylinder 105. This relative velocity changes at a period of one turn. Accordingly, the blade 113 moves inwardly and outwardly in the groove 111.

The blade 113 defines a plurality of work chambers 115 between the rotary rod 109 and the cylinder 105 along the rotary rod 109. The volume of each work chamber 115 is determined by a corresponding pitch P of the helical groove 111 to which the blade 113 is fitted as shown in FIG. 2. The pitches of the groove 111 gradually shorten from the suction side of the rotary rod 109 toward the discharge side thereof. Namely, the volumes of the work chambers 115 defined by the blade 113 gradually decrease from the suction side of the rotary rod 109 adjacent to a suction pipe 117 toward the discharge side thereof adjacent to a discharge pipe 119, so that the coolant is gradually compressed and conveyed from the suction side toward the discharge side.

In this way, a configuration of the blade 113, rotary rod 109, and cylinder 105 determines the volumes of the work chambers 115, and a suction pressure determines a discharge pressure.

The conventional helical blade fluid compressor is operated on the basis of a predetermined discharge pressure. If an excessively large or small volume of coolant is fed into the work chambers 115, the compressor cannot deal with it and causes excessive or insufficient compression. The excessive compression, in particular, causes large load to adversely affect the drive means and blade, thereby lowering reliability.

If oil, or liquid coolant is drawn into the work chambers 115, it will cause an excessively high pressure in the work chambers 115 on the discharge side, to produce excessive load to break the drive means and blade.

SUMMARY OF THE INVENTION

An object of the invention is to provide a fluid compressor that produces a proper working pressure in response to changes in operating conditions.

Another object of the invention is to provide a fluid compressor that is efficiently operable under various operating conditions.

In order to accomplish the objects, an aspect of the invention provides a fluid compressor comprising a cylinder having a suction port and a discharge port; a cylindrical rotary member eccentrically disposed in and along the cylinder so that the periphery thereof may partly be in contact with the inner face of the cylinder, the cylinder and rotary member being relatively turnable; a helical groove formed around the rotary member at pitches that gradually reduce from the suction port side toward the discharge port side; a helical blade movably fitted in the helical groove, the periphery of the blade being in contact with the inner face of the cylinder, the blade defining a plurality of work chambers between the inner face of the cylinder and the peripheral face of the rotary member; and drive means for relatively turning the rotary member and cylinder. The rotary member and cylinder are relatively turned so that a fluid Is drawn into the work chambers through the suction port, successively compressed and conveyed through the work chambers toward the discharge port, and discharged from the discharge port.

According to this aspect of the invention, the rotary member has a communication path communicating with the bottom of the helical groove and with the discharge port of the cylinder, and at least one control valve for releasing pressure from a corresponding one of the work chambers if the pressure in the work chamber acting on the blade exceeds a predetermined value during a compressing process.

The control valve operates when excessive pressure is produced in the corresponding work chamber due to changes in operating conditions during a compressing process, to free the pressure into the communication path, thereby restoring pressure appropriate for the operating conditions.

Another aspect of the invention provides a fluid compressor comprising a cylinder disposed in a closed casing and having a suction port and a discharge port; a cylindrical rotary member eccentrically disposed in and along the cylinder so that the periphery thereof is partly in contact with the inner face of the cylinder, the cylinder and rotary member being relatively turnable; a helical groove formed around the rotary member at pitches that gradually reduce from the suction port side toward the discharge port side; a helical blade movably fitted in the helical groove, the periphery of the blade being in contact with the inner face of the cylinder, the blade defining a plurality of work chambers between the inner face of the cylinder and the periphery of the rotary member; and drive means for relatively turning the rotary member and cylinder. The rotary member and cylinder are relatively turned so that a fluid is drawn into the work chambers through the suction port, successively compressed and conveyed through the work chambers toward the discharge port, and discharged from the discharge port.

According to this aspect of the invention, at least one work chamber on the discharge port side is provided with a closing valve. When pressure in the work chamber exceeds a predetermined value, the valve opens to free the pressure of the work chamber into the work chamber communicated to the discharge port of discharge pressure.

Still another aspect of the invention provides a fluid compressor comprising a cylinder disposed in a closed casing and having a suction port and a discharge port; a cylindrical rotary member eccentrically disposed in and along the cylinder so that the periphery thereof may partly be in contact with the inner face of the cylinder, the cylinder and rotary member being relatively turnable; a helical groove formed around the rotary member at pitches that gradually reduce from the suction port side toward the discharge port side; a helical blade movably fitted in the helical groove, the periphery of the blade being in contact with the inner face of the cylinder, the blade defining a plurality of work chambers between the inner face of the cylinder and the peripheral face of the rotary member; and drive means for relatively turning the rotary member and cylinder. The rotary member and cylinder are relatively turned so that a fluid is drawn into the work chambers through the suction port, successively compressed and conveyed through the work chambers toward the discharge port, and discharged from the discharge port.

This aspect of the invention employs a main path for connecting the suction port with the work chamber on the suction port side, a secondary path communicating with the work chamber, a control valve for opening and closing the secondary path, and operation means for activating the control valve. The valve may be opened by the operation means during a compressing process, to start the compressing process from an intermediate compressing stage, thereby changing a displacement and compression ratio of the compressor.

These and other objects, features and advantages of the invention will be more apparent from the following detailed description of preferred embodiments in conjunction with the accompanying drawings.

DETAILED DESCRIPTION OF THE EMBODIMENTS

A fluid compressor according to a first embodiment of the invention will be explained in detail with reference to FIGS. 3 to 5.

Figure 1:
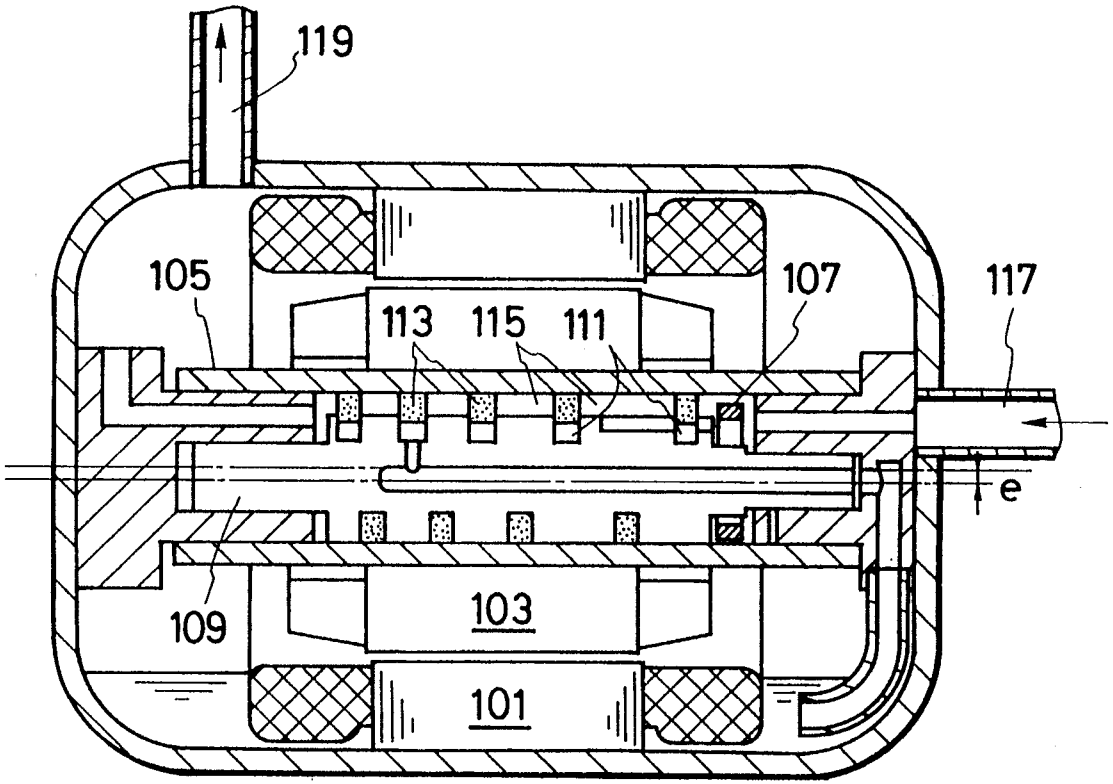
FIG. 1 is a sectional view showing a fluid compressor according to a prior art.
Figure 2:
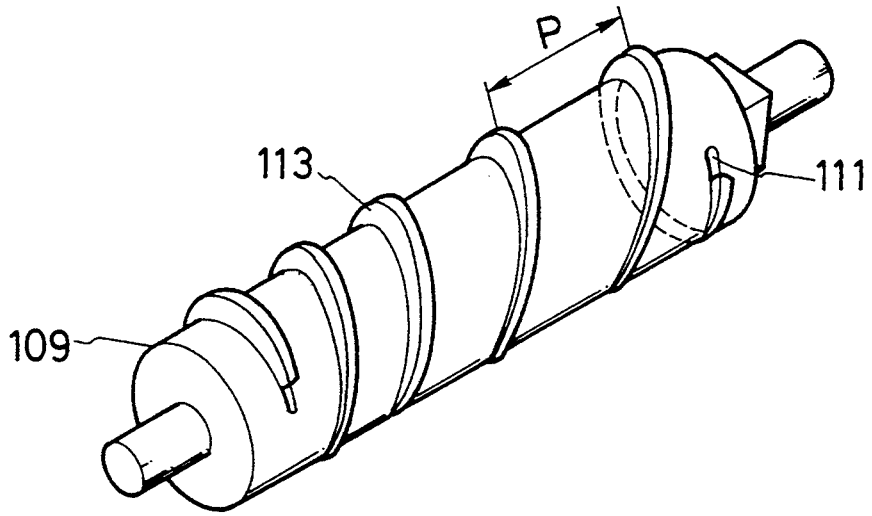
FIG. 2 is a perspective view showing a rotary member of the fluid compressor of FIG. 1.
Figure 3:
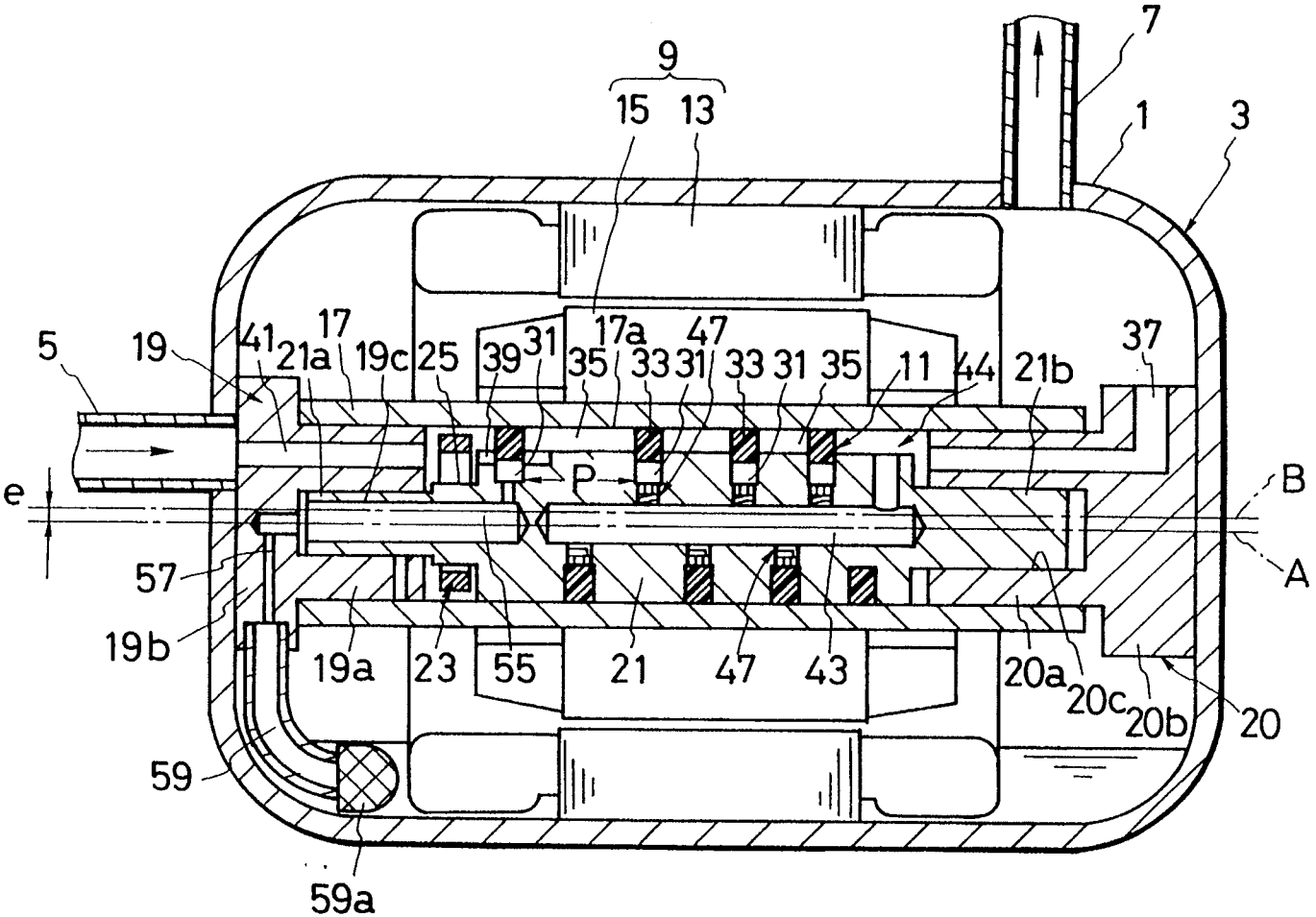
FIG. 3 is a sectional view showing a fluid compressor according to a first embodiment of the invention.

In FIG. 3, the fluid compressor 3 is of a closed type used for a refrigerating cycle. The compressor 3 comprises a closed casing 1, a suction pipe 5 connected to one end of the casing 1, and a discharge pipe 7 connected to the other end of the casing 1. The casing 1 incorporates a motor 9 serving as drive means, and a compression element 11 serving as compression means.

The motor 9 comprises a stator 13 fixed to the inner face of the casing 1 and a rotor 15 rotatably disposed inside the stator 13.

The compression element 11 comprises a cylinder 17 having open ends. These ends of the cylinder 17 are rotatably supported by bearings 19 and 20, which are fixed to the inner face of the casing 1. The bearing 19 (20) comprises a boss portion 19*a* (20*a*) for rotatably receiving one end of the cylinder 17, and a base portion 19*b* (20*b*) fixed to the inner face of the casing 1. The diameter of the base portion 19*b* (20*b*) is larger than that of the boss portion 19*a* (20*a*). The ends of the cylinder 17 are airtightly sealed.

A rotary member 21 is disposed in and along the cylinder 17. The rotary member 21 is made of iron-based material or other material. A center axis A of the rotary member 21 is eccentric to a center axis B of the cylinder 17. Namely, the axis A is downwardly displaced from the axis B by a distance of "e" as shown in FIG. 3, so that part of the rotary member 21 is in linear contact with the inner face of the cylinder 17.

Ends of the rotary member 21 form thin support portions 21*a* and 21*b*, which are rotatably inserted into and supported by bearing holes 19*c* and 20*c*, respectively. The bearing holes 19*c* and 20*c* are formed in the boss portions 19*a* and 20*a* of the bearings 19 and 20, respectively.

The support portion 21*a* of the rotary member 21 has a square portion 25 having a square cross section for providing power transmission faces to which torque of the cylinder 17 is transmitted through an oldham ring 23.

Figure 9:
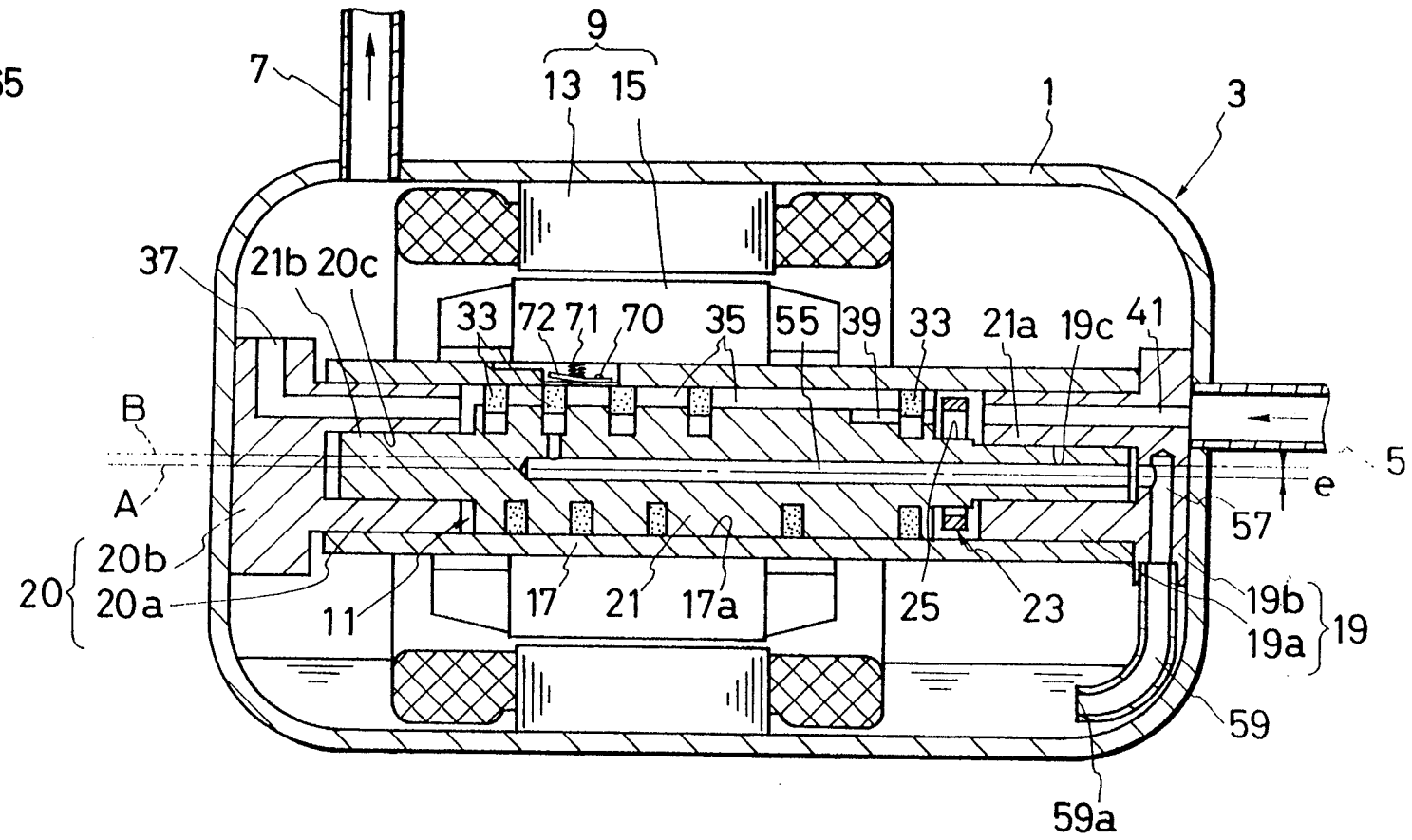
FIG. 9 is a sectional view showing a fluid compressor according to a second embodiment of the invention.

As shown in FIG. 9, the oldham ring 23 has a rectangular long hole 26 into which the square portion 25 of the rotary member 21 is inserted with a clearance between them. Due to the clearance, the square portion 25 can slide in the long hole 26. The periphery of the oldham ring 23 has holes for receiving one end of a pair of transmission pins 27. These pins are free to slide in the holes in a diametral direction orthogonal to the length of the long hole 26. The other ends of the transmission pins 27 are fixed in holes 29 formed in the inner wall of the cylinder 17. Accordingly, the rotary member 21 is smoothly connected to the cylinder 17 at the eccentric position, and the torque of the cylinder 17 is transmitted to the rotary member 21 through the oldham ring 23.

When the motor 9 is energized, the cylinder 17 rotates with the rotor 15, and the rotary member 21 eccentrically turns relative to the cylinder 17 through the oldham ring 23. At this time, a relative velocity difference occurs between the periphery of the rotary member 21 and the inner face of the cylinder 17. This relative velocity difference changes at a period of one turn. The rotary member 21 turns in and relative to the cylinder 17.

In FIG. 3, a helical groove 31 is formed around the rotary member 21. Pitches P of the helical groove 31 gradually reduce from a suction port on the left-hand side in FIG. 3 toward a discharge port on the right-hand side in the same Figure.

A helical blade 33 is fitted in the helical groove 31. The blade 33 is made of elastic synthetic resin. Due to the elasticity, the blade 33 is movable inwardly and outwardly in the groove 31. The blade 33 defines work chambers 35 between the cylinder 17 and the rotary member 21. The first work chamber 35 adjacent to the suction port has the largest volume. Volumes of the work chambers 35 gradually decrease from the suction port toward the discharge port. The last work chamber 35 adjacent to the discharge port communicates with a discharge hole 37, which is formed in the bearing 20 and open in the casing 1.

Each work chamber 35 extends along the blade 33 from one contact portion between the rotary member 21 and an inner face 17*a* of the cylinder 17 to the next contact portion, to form a crescent shape.

The first work chamber 35 adjacent to the suction port is connected to the suction pipe 5 of the refrigerating cycle through a first suction hole 39 formed in the end of the rotary member 21 and a second suction hole 41 formed in the bearing 19. Accordingly, a coolant gas is surely and continuously guided from the suction pipe 5 into the first work chamber 35 in the cylinder 17.

The rotary member 21 has a longitudinal communication path 43 communicating with the bottom of the helical groove 31 and extending along the rotary member 21. An end of the communication path 43 communicates with a discharge end 44 of the cylinder 17, and the other end thereof is blinded.

Figure 4:
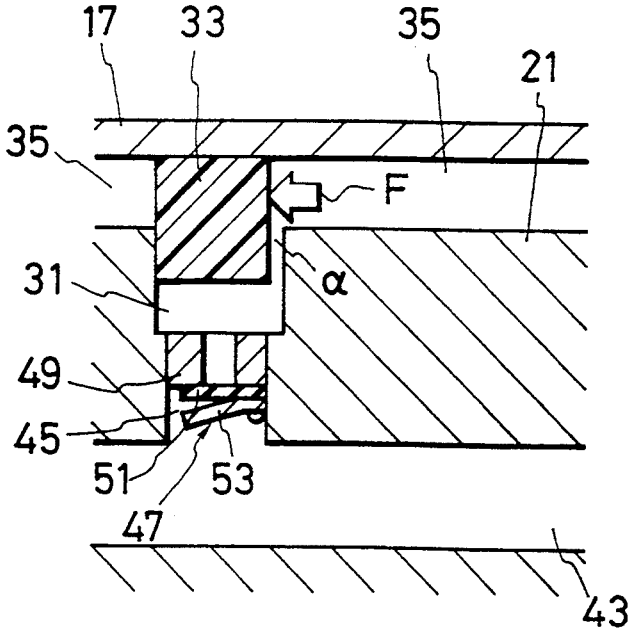
FIG. 4 is a view explaining a control valve of the fluid compressor of FIG. 3.
Figure 5:
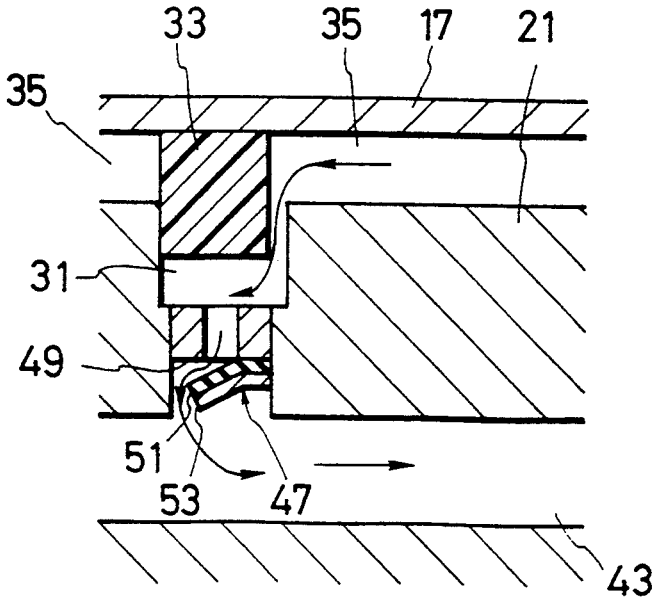
FIG. 5 is a view explaining an operation of the control valve of FIG. 4.

As shown in FIG. 4, a control valve 47 is disposed in a path 45 that connects the bottom of the groove 31 with the communication path 43. The control valve 47 comprises a valve seat 49 disposed in the path 45, an elastic valve disk 51 movable toward and away from the valve seat 49, and a stopper 53. These elements are assembled into a unit, which is forcibly inserted into the path 45 in the groove 31 before the blade 33 is fitted into the groove 31.

The valve disk 51 is usually in contact with the valve seat 49. When pressure in the work chamber 35 exceeds a predetermined value, a force F pushes the side face of the blade 33 toward a lower pressure side to form a gap $\alpha$ at the side of the blade 33 as shown in FIG. 4. Due to pressure escaping through the gap $\alpha$, the valve disk 51 is moved away from the valve seat 49 and stopped by the stopper 53.

Referring again to FIG. 3, the rotary member 21 has a lubricant path 55. One end of the lubricant path 55 is connected to the bottom of the helical groove 31, and the other end thereof to a communication hole 57 formed in the bearing 19. The hole 57 communicates with a guide tube 59 having a suction mouth 59*a* open to the bottom of the casing 1. When pressure in the casing 1 increases, lubricant stored at the bottom of the casing 1 is supplied into the helical groove 31 through the guide pipe 59, communication hole 57, and lubricant path 55, to help the blade 33 smoothly move inwardly and outwardly in the groove 31.

An operation of the fluid compressor of FIG. 3 will be explained.

The motor 9 is energized to turn the rotor 15 and cylinder 17 together. The rotary member 21 is then turned through the oldham ring 23. Since the rotary member 21 is eccentric to the cylinder 17, a relative velocity difference occurs between the inner face of the cylinder 17 and the periphery of the rotary member 21. The relative velocity difference changes at a period of one turn of the cylinder 17. The rotary member 21 turns in and relative to the cylinder 17. As a result, a fluid such as a coolant gas is fed into the first work chamber 35 located in the vicinity of the suction port. The coolant is successively compressed and conveyed through the work chambers 35 and discharged into the discharge pipe 7 from the last work chamber 35 located in the vicinity of the discharge port.

If a large amount of coolant is fed into the work chambers 35 due to, for example, changes in operating conditions, pressure in the work chambers 35 may exceed a predetermined value. The excessive pressure forms a gap $\alpha$ at the side of the blade 33 and acts on the valve disk 51 through the gap $\alpha$. The valve disk 51, therefore, is moved away from the valve seat 49, to release the pressure from the work chambers 35 to the communication path 43 and then to the discharge end 44. When the work chambers 35 restore the predetermined pressure, the valve disk 51 returns, due to its resiliency, onto the valve seat 49.

This arrangement prevents excessive load from adversely affecting the blade 33 and motor 9, and provides an optimum working pressure for operating conditions of the fluid compressor.

Figure 6:
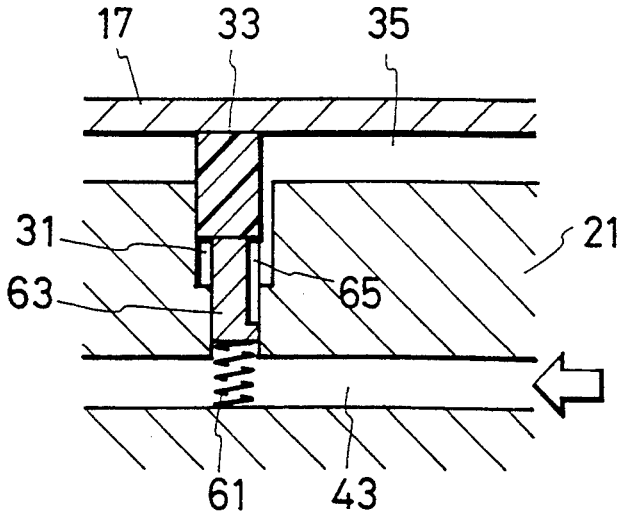
FIG. 6 is a view explaining a piston rod type control valve according to the invention.
Figure 7:
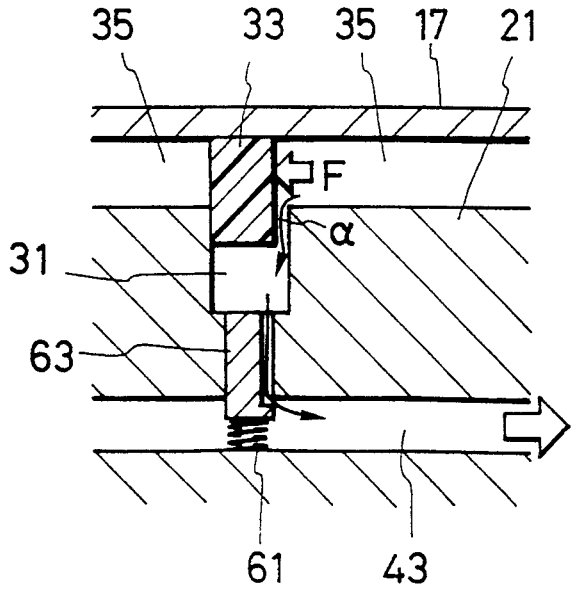
FIG. 7 is a view explaining an operation of the control valve of FIG. 6.
Figure 8:
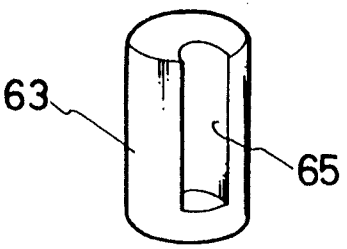
FIG. 8 is a perspective view showing a rod of the control valve of FIG. 6.

FIGS. 6, 7, and 8 show a piston rod type valve as a modification of the control valve 47 for freeing the pressure F from the corresponding work chamber 35 to the communication path 43.

In the Figures, a spring 61 usually pushes a rod 63 against the bottom of the blade 33. The rod 63 is disposed in the path 45 that connects the bottom of the helical groove 31 with the communication path 43. The rod 63 has an undercut 65.

When pressure in the work chamber 35 exceeds the spring force of the spring 61, the rod 63 is pushed down so that the pressure may escape to the communication path 43 through the undercut 65. Since the blade 33 is always pushed against the cylinder 17 by the rod 63, a contact pressure between the periphery of the blade 33 and the inner face of the cylinder 17 is secured to achieve a good sealed state.

In this way, the fluid compressor according to the first embodiment of the invention employs the control valve to eliminate excessive pressure from the work chambers and establish an optimum working pressure for operating conditions of the compressor. This arrangement prevents excessive load from adversely affecting the blade and drive means, and improves reliability of the compressor.

Figure 10:
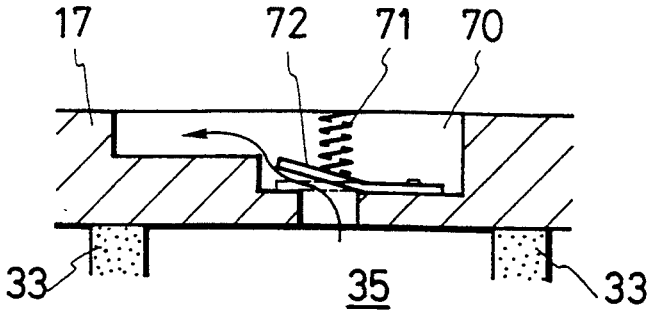
FIG. 10 is an enlarged sectional view showing a closing valve of the fluid compressor of FIG. 9.
Figure 11:
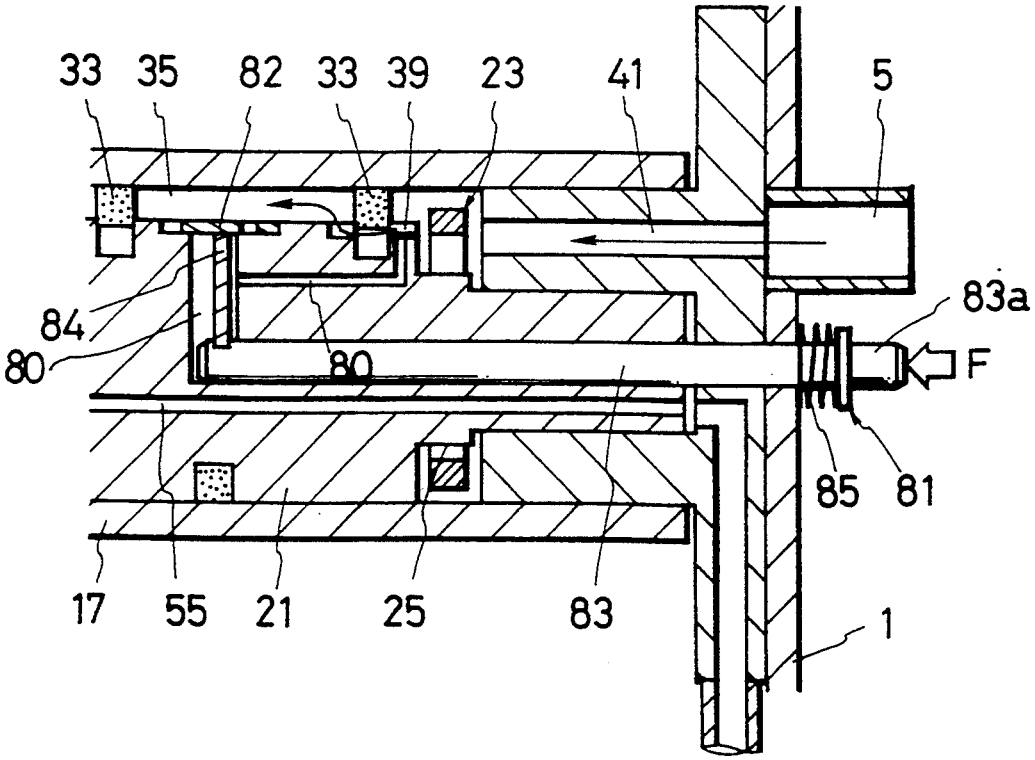
FIG. 11 is an enlarged sectional view showing essential part of a fluid compressor according to a third embodiment of the invention.
Figure 12:
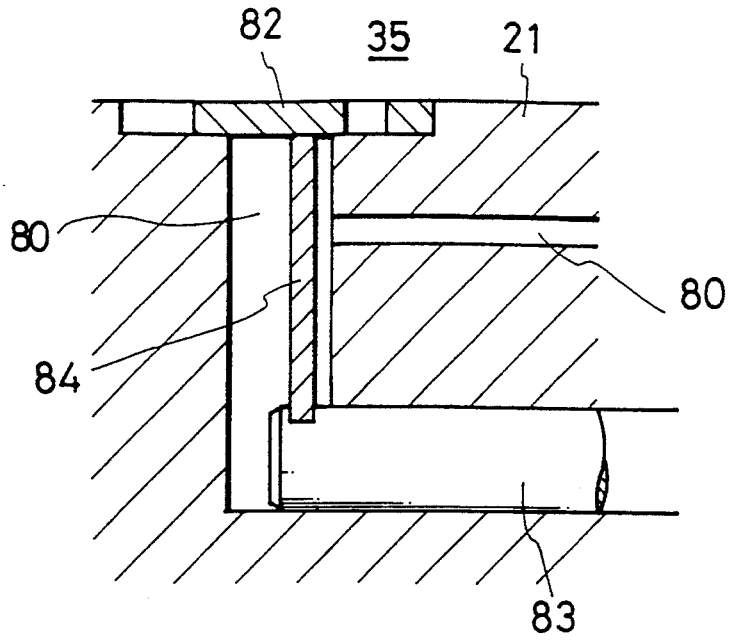
FIG. 12 is a view showing an operation of a control valve of the fluid compressor of FIG. 11.

FIGS. 9 and 10 show a fluid compressor according to a second embodiment of the invention. In these Figures, the same elements as those of the first embodiment are represented with like numerals.

The fluid compressor 3 of the second embodiment is of a closed type used for a refrigerating cycle. The compressor 3 comprises a closed casing 1, a suction pipe 5 connected to one end of the casing 1, and a discharge pipe 7 connected to the other end of the casing 1. The casing 1 incorporates a motor 9 serving as drive means, and a compression element 11 serving as compression means.

The motor 9 comprises a stator 13 fixed to the inner face of the casing 1, and a rotor 15 rotatably disposed inside the stator 13.

The compression element 11 comprises a cylinder 17 having open ends. These ends of the cylinder 17 are rotatably supported by bearings 19 and 20, which are fixed to the inner face of the casing 1. The bearing 19 (20) comprises a boss portion 19*a* (20*a*) for rotatably receiving one end of the cylinder 17, and a base portion 19*b* (20*b*) fixed to the inner face of the casing 1. The diameter of the base portion 19*b* (20*b*) is larger than that of the boss portion 19*a* (20*a*). The ends of the cylinder 17 are airtightly sealed.

A rotary member 21 is disposed in and along the cylinder 17. The rotary member 21 is made of iron-based material or other material. A center axis A of the rotary member 21 is eccentric to a center axis B of the cylinder 17. Namely, the axis A is downwardly displaced from the axis B by a distance of "e" as shown in FIG. 9, so that part of the rotary member 21 is in linear contact with the inner face of the cylinder 17.

Ends of the rotary member 21 form thin support portions 21*a* and 21*b*, which are rotatably inserted into and supported by bearing holes 19*c* and 20*c*, respectively. The bearing holes 19*c* and 20*c* are formed in the boss portions 19*a* and 20*a* of the bearings 19 and 20, respectively.

The support portion 21*a* of the rotary member 21 has a square portion 25 having a square cross section for providing power transmission faces to which torque of the cylinder 17 is transmitted through an oldham ring 23. The oldham ring 23 has a rectangular long hole 26 into which the square portion 25 of the rotary member 21 is inserted with a clearance between them. Due to the clearance, the square portion 25 can slide in the long hole 26.

The periphery of the oldham ring 23 has holes for receiving one end of a pair of transmission pins 27. These pins are free to slide in the holes in a diametral direction orthogonal to the length of the long hole 26. The other ends of the transmission pins 27 are fixed in holes 29 formed in the inner wall of the cylinder 17. With this arrangement, the rotary member 21 is smoothly connected to the cylinder 17 at the eccentric position, and the torque of the cylinder is transmitted to the rotary member 21 through the oldham ring 23.

When the motor 9 is energized, the cylinder 17 rotates with the rotor is, and the rotary member 21 eccentrically turns relative to the cylinder 17 through the oldham ring 23. At this time, a relative velocity difference occurs between the periphery of the rotary member 21 and the inner face of the cylinder 17. This relative velocity difference changes at a period of one turn. The rotary member 21 turns in and relative to the cylinder 17.

A helical groove 31 is formed around the rotary member 21. Pitches P of the helical groove 31 gradually reduce from a suction port on the right-hand side in FIG. 9 toward a discharge port on the left-hand side in the same Figure.

A helical blade 33 is fitted in the helical groove 31. The blade 33 is made of elastic synthetic resin. Due to the elasticity, the blade 33 is movable inwardly and outwardly in the groove 31. The blade 33 defines work chambers 35 between the cylinder 17 and the rotary member 21. The first work chamber 35 adjacent to the suction port has the largest volume. Volumes of the work chambers 35 gradually decrease from the suction port toward the discharge port. The last work chamber 35 adjacent to the discharge port communicates with a discharge hole 37, which is formed in the bearing 20 and open to the casing 1.

Each work chamber 35 extends along the blade 33 from one contact portion between the rotary member 21 and an inner face 17*a* of the cylinder 17 to the next contact portion, to form a crescent shape.

The first work chamber 35 at the suction port is connected to the suction pipe 5 of the refrigerating cycle through a main path 39 formed in the end of the rotary member 21 and a suction hole 41 formed in the bearing 19. Accordingly, a coolant gas is surely and continuously guided from the suction pipe 5 into the first work chamber 35 in the cylinder 17.

In FIG. 10, the cylinder 17 has an open valve chamber 70 for one of the work chambers 35. This work chamber can communicate with the inside of the casing 1 through the valve chamber 70. The valve chamber 70 accommodates a closing valve 72 and a spring 71 for pushing the valve 72. When pressure in the work chamber 35 exceeds a predetermined value, the pressure opens the valve 72 against the force of the spring 71 and escapes into the casing 1.

Referring again to FIG. 9, the rotary member 21 has a lubricant path 55. One end of the lubricant path 55 is connected to the bottom of the helical groove 31, and the other end thereof to a communication hole 57 formed in the bearing 19. The hole 57 communicates with a guide tube 59 having a suction mouth 59*a* open to the bottom of the casing 1. When pressure in the casing 1 increases, lubricant stored at the bottom of the casing 1 is supplied into the helical groove 31 through the guide pipe 59, communication hole 57, and lubricant path 55, to help the blade 33 smoothly moving inwardly and outwardly in the groove 31.

An operation of the fluid compressor of the second embodiment will be explained.

The motor 9 is energized to turn the rotor 15 and cylinder 17 together. The rotary member 21 is then turned through the oldham ring 23. Since the rotary member 21 is eccentric to the cylinder 17, a relative velocity difference occurs between the inner face of the cylinder 17 and the periphery of the rotary member 21. The relative velocity difference changes at a period of one turn of the cylinder 17. The rotary member 21 turns in and relative to the cylinder 17. As a result, a fluid such as a coolant gas is fed into the first work chamber 35 located in the vicinity of the suction port. The coolant is successively compressed and conveyed through the work chambers 35 and discharged into the discharge pipe 7 from the last work chamber 35 located in the vicinity of the discharge port.

When a large amount of coolant is fed into the work chambers 35 due to, for example, changes in operating conditions, pressure in the work chambers 35 may exceed a predetermined value. The excessive pressure opens the valve 72 (FIG. 10) and escapes into the casing 1. When the work chambers 35 restore the predetermined pressure, the valve 72 is closed by the spring 71. This arrangement prevents a loss of power and always provides an optimum discharge pressure for operating conditions of the compressor.

This arrangement is also effective to return lubricant into the casing 1, when a large amount of lubricant enters the work chambers 35 due to some reason.

FIGS. 11 to 14 show a fluid compressor according to a third embodiment of the invention. This embodiment controls a displacement and compression ratio of the compressor by opening and closing a control valve. In FIGS. 11 to 14, the same elements as those of the second embodiment are represented with like numerals, and their explanations are not repeated.

Figure 13:
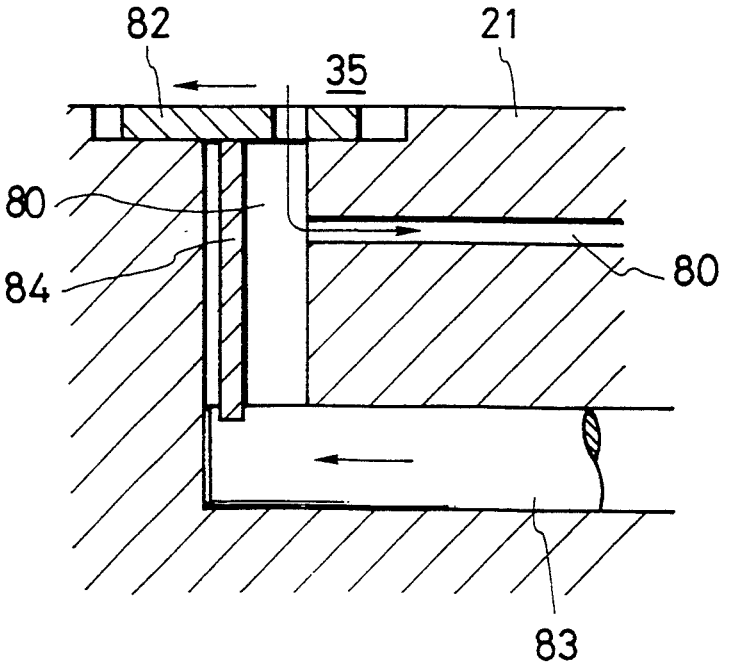
FIG. 13 is a view showing an operation of the control valve of FIG. 12.
Figure 14:
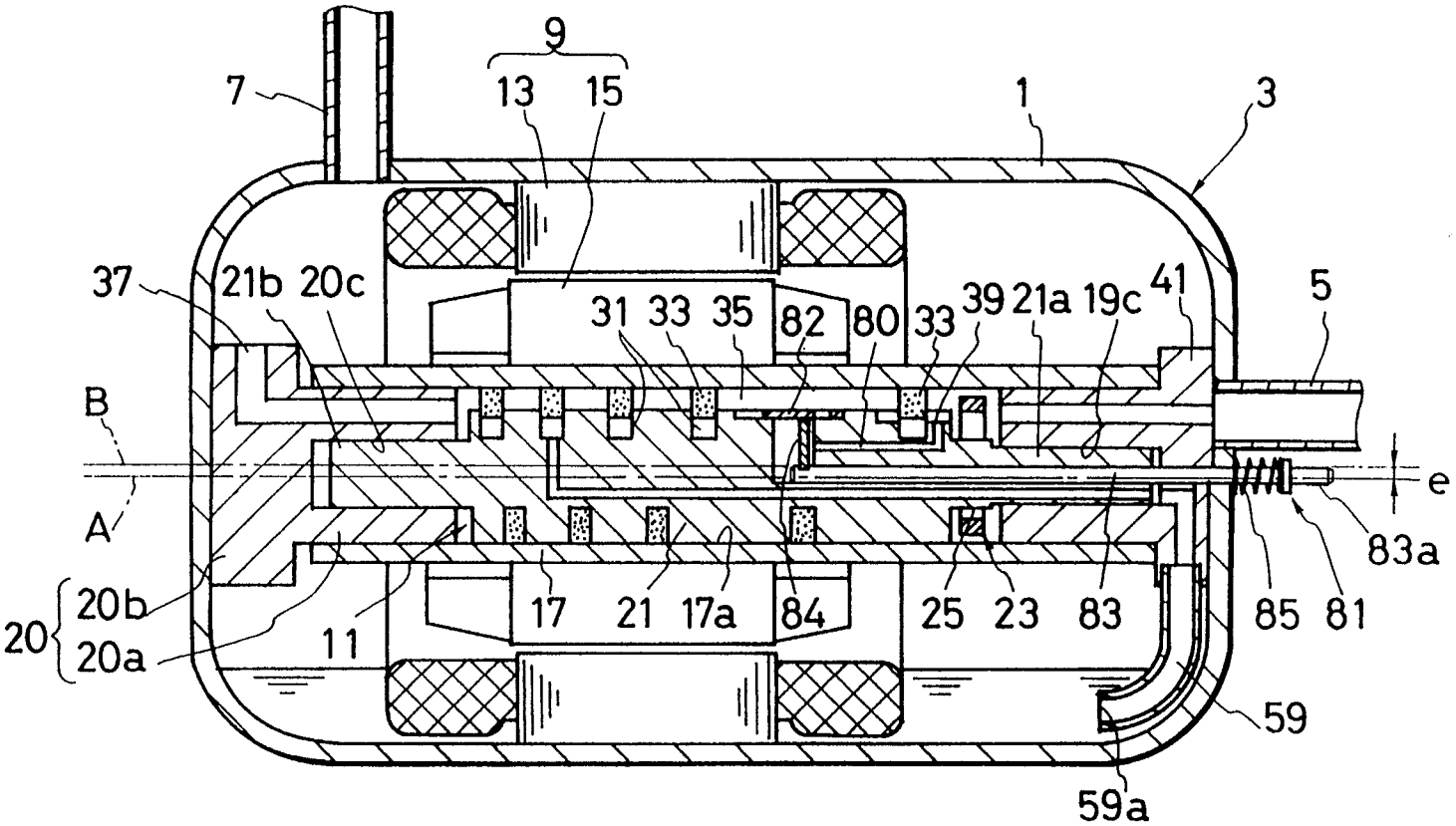
FIG. 14 is a sectional view showing the fluid compressor according to the third embodiment of the invention.

A secondary path 80 is arranged outside the main path 39 of the rotary member 21. The secondary path 80 is able to connect the work chamber 35 with the suction path 41 during a compressing process. A control valve 82 is disposed in the secondary path 80. The control valve 82 is opened and closed by operation means 81. The operation means 81 has an operation rod 83. The operation rod 83 is disposed in the rotary member 21 along the center axis A. One end of the operation rod 83 protrudes from the casing 1, and the other end thereof is connected to the control valve 82 through a connection member 84. The operation rod 83 has a spring 85, which usually pulls the control valve 82 to close the secondary path 80. The part of the operation rod 83 protruding from the casing 1 forms an operation portion 83*a*, which may be pushed in the direction of an arrow mark F to open the control valve 82 as shown in FIG. 13.

When the operation portion 83*a* is pushed to open the control valve 82 during a compressing process, pressure in the work chamber 35 escapes through the secondary path 80.

In this way, controlling the control valve 82 changes a displacement and compression ratio of the compressor.

Figure 15:
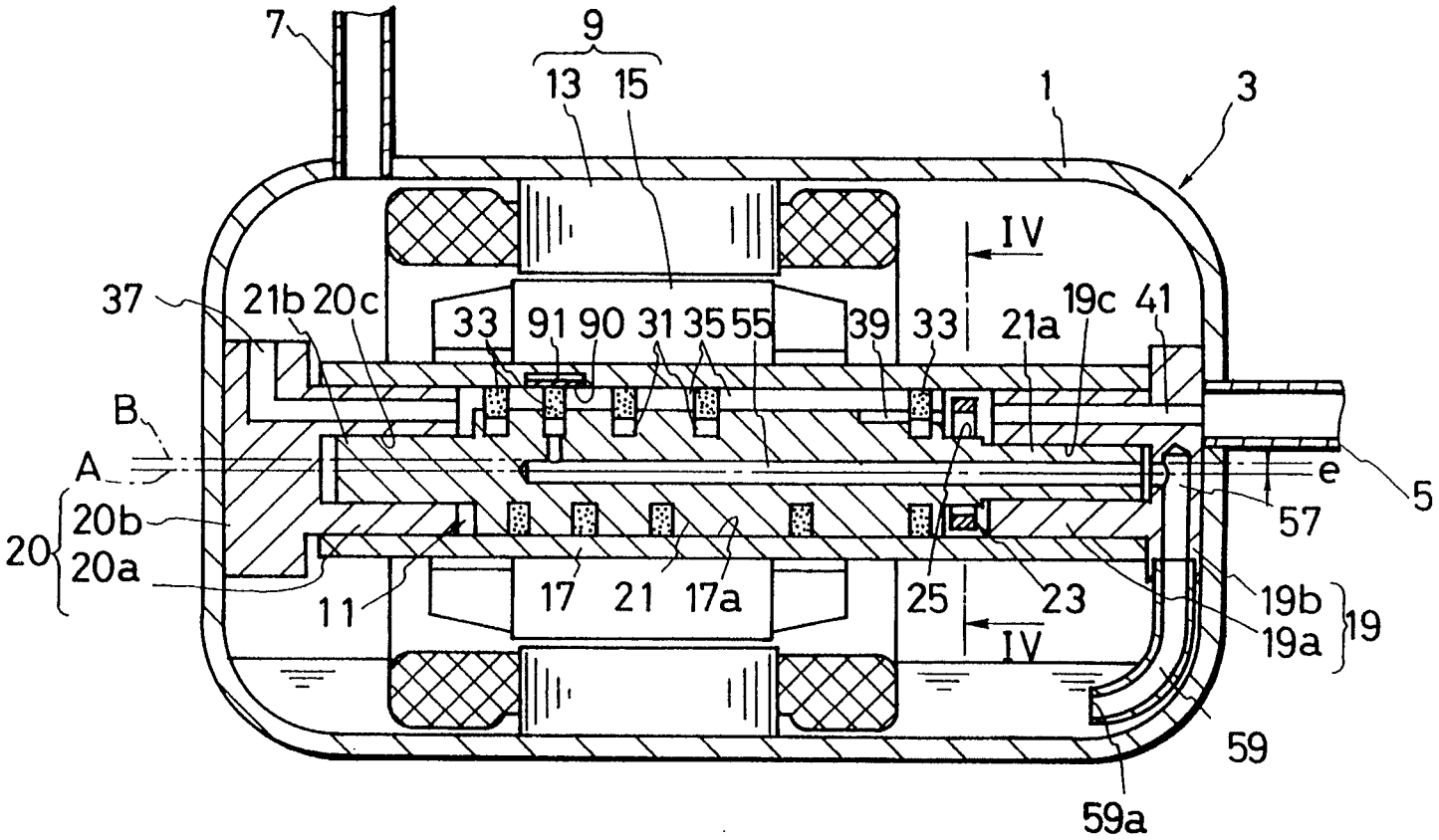
FIG. 15 is a sectional view showing a fluid compressor according to a fourth embodiment of the invention.
Figure 16:
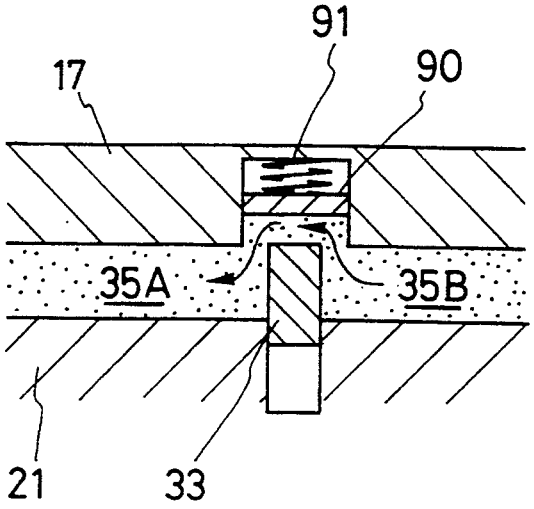
FIG. 16 is an enlarged sectional view showing a closing valve of the fluid compressor of FIG. 15.

FIGS. 15 and 16 show a fluid compressor according to a fourth embodiment of the invention. In these Figures, the same elements as those of the second embodiment are represented with like numerals, and their explanations are not repeated.

In FIG. 16, a work chamber 35A receives discharge pressure, and a work chamber 35B is located adjacent to the work chamber 35A. A closing valve 90 is disposed over a part of the blade 33 that separates the work chambers 35A and 35B from each other.

In FIG. 15, the groove 31 under the blade 33 on the suction side of the work chamber 35B communicates with the discharge hole 37 through a path 92.

The valve 90 is usually pushed toward the blade 33 by a spring 91, thereby separating the work chambers 35A and 35B from each other. The spring force of the spring 91 is so set that the valve 90 is opened when pressure in the work chamber 35B exceeds a predetermined value. When the valve 90 is opened, the lower pressure in the work chamber 35B escapes into the work chamber 35A of higher pressure, as indicated with arrow marks (FIG. 16), thereby restoring the predetermined pressure.

In summary, the fluid compressor according to the invention secures an optimum discharge pressure for operating conditions of the compressor, thereby maintaining efficient operation of the compressor. Also, the invention controls a displacement and compression ratio of the compressor to cover wide operating conditions.

Various modifications will become possible for those skilled in the art after receiving the teachings of the present disclosure without departing from the scope thereof.

What is claimed is:

1. A fluid compressor for sucking, compressing, and discharging a fluid, comprising:

(a) a cylinder having a suction port and a discharge port;

(b) a cylindrical rotary member eccentrically disposed in and along said cylinder so that the periphery thereof may partly be in contact with the inner face of said cylinder, said cylinder and rotary member being relatively turntable;

(c) a helical groove formed around said rotary member at pitches that gradually reduce from the suction port side toward the discharge port side;

(d) a helical blade movably fitted in said helical groove, the periphery of said blade being in contact with the inner face of said cylinder, said blade defining a plurality of work chambers between the inner face of said cylinder and the peripheral face of said rotary member;

(e) drive means for relatively turning said rotary member and cylinder so that the fluid is drawn into the work chambers through the suction port, successively compressed and conveyed through the work chambers toward the discharge port, and discharged from the discharge port;

(f) a one-way communication path connecting the bottom of said helical groove to the discharge port of said cylinder; and (g) control valve means for releasing pressure from the work chambers if the pressure in the work chambers exceeds a predetermined value during a compressing process;

wherein said one-way communication path is formed in said rotary member; and wherein part of said one-way communication path forms a path extending in the same direction as said groove, and said control valve means includes a piston rod disposed in the path, the piston rod being pushed to the bottom of said blade and having an undercut for releasing pressure from the work chambers only when the pressure exceeds the predetermined value.

2. The fluid compressor according to claim 10, wherein part of said communication path forms a path extending in the same direction as said groove, and said control valve includes a valve seat inserted in the path and a valve disk that resiliently moves toward and away from the valve seat when pressure in said at least one of said work chambers changes respectively below and above the predetermined value.

3. A fluid compressor comprising:

a closed outer casing having a suction port through which a fluid to be compressed flows into said compressor and a discharging port through which the fluid compressed by said compressor flows out;

a cylinder having an inner cylindrical surface and being rotatably supported around a first rotation axis in said casing with an inner space between said cylinder and said casing, said inner space communicating with the discharging port;

a cylindrical rotary member having an outer cylindrical surface and a diameter smaller than that of the inner cylindrical surface of said cylinder and being rotatably supported in said casing around a second rotation axis A parallel to but displaced from said first axis in order that the outer cylindrical surface of said cylindrical rotary member makes contact with the inner cylindrical surface of said cylinder;

an Oldham coupling provided between said cylinder and said cylindrical rotary member;

a motor supported by said casing in order to rotate said cylinder and said cylindrical rotary member around said first and second rotation axes respectively; and a helical blade having a pitch decreasing from one end near the suction port to an other end near the discharging port and being interposed between the inner cylindrical surface of said cylinder and the outer cylindrical surface of said cylindrical rotary member in order to partition a space therebetween into a plurality of work chambers, the work chamber closest to said one end of said helical blade communicating with the suction port, the work chamber closest to the other end of said helical blade communicating with said inner space between said cylinder and said casing, wherein the outer surface of said cylindrical rotary member is formed with a helical groove with which said helical blade is slidably engaged, and wherein a one-way communication path is formed to connect said inner space to at least one of said work chambers with a control valve which opens when a differential pressure between said inner space and said at least one of said work chambers exceeds a predetermined value.

4. The compressor of claim 3 wherein said one-way communication path is formed in said cylindrical rotary member.

5. The compressor of claim 3 wherein said control valve is provided in a hole opened in said helical groove and communicating with said communication path.

6. The compressor of claim 5 wherein said control valve comprises a rod slidably engaged with said hole and an elastic member provided in said communication path in order to urge said rod against said blade, said rod being adapted to form a passage between said groove and said communication path when said rod is forced to slide apart from said blade against the elastic force of said elastic member by the differential pressure between said inner space and said at least one of said work chambers.

7. The compressor of claim 6 wherein said rod is formed with an undercut extending from one end of said rod contacting said blade to an intermediate position which appears in said communication path when said rod slides apart from said blade against the elastic force of said elastic member by the differential pressure between said inner space and said at least one of said work chambers.

* * * * *